US005697430A

United States Patent [19]

Thors et al.

[11] Patent Number: 5,697,430

[45] Date of Patent: Dec. 16, 1997

[54] HEAT TRANSFER TUBES AND METHODS OF FABRICATION THEREOF

[75] Inventors: Petur Thors; Norman R. Clevinger; Bonnie J. Campbell; James T. Tyler, all of Decatur, Ala.

[73] Assignee: Wolverine Tube, Inc., Decatur, Ala.

[21] Appl. No.: 486,576

[22] Filed: Jun. 7, 1995

Related U.S. Application Data

[63] Continuation-in-part of Ser. No. 417,047, Apr. 4, 1995, abandoned.

[51] Int. Cl.[6] ..... F28F 1/16; F28F 1/42

[52] U.S. Cl. ..... 165/133; 165/184; 165/DIG. 516; 165/179; 165/911; 29/890.05

[58] Field of Search ..... 165/133, 179, 165/184, 911; 29/890.05

[56] References Cited

U.S. PATENT DOCUMENTS

| | | | |
|---|---|---|---|
| 3,496,752 | 2/1970 | Kun et al. | 165/133 X |
| 3,779,312 | 12/1973 | Withers, Jr. et al. | 165/184 |
| 3,847,212 | 11/1974 | Withers, Jr. et al. | 165/179 |
| 3,881,342 | 5/1975 | Thorne | 72/68 |
| 4,060,125 | 11/1977 | Fujie et al. | 165/133 |
| 4,660,630 | 4/1987 | Cunningham et al. | 165/133 |
| 4,729,155 | 3/1988 | Cunningham et al. | 29/157.3 AH |
| 4,765,058 | 8/1988 | Zohler | 29/727 |
| 4,921,042 | 5/1990 | Zohler | 165/179 |
| 4,938,282 | 7/1990 | Zohler | 165/133 |
| 5,052,476 | 10/1991 | Sukumoda et al. | 165/133 |
| 5,054,548 | 10/1991 | Zohler | 165/133 |
| 5,146,979 | 9/1992 | Zohler | 165/133 |
| 5,186,252 | 2/1993 | Nishizawa et al. | 165/181 |
| 5,203,404 | 4/1993 | Chiang et al. | 165/133 |
| 5,222,299 | 6/1993 | Zohler | 29/890.048 |
| 5,333,682 | 8/1994 | Liu et al. | 165/133 |
| 5,513,699 | 5/1996 | Menze et al. | 165/133 |

OTHER PUBLICATIONS

D.L. Gee & R.L. Webb "Forced Convection Heat Transfer in Helically Rib-Rougnened Tubes" pp. 1,127—1,136 (1980) International Journal of Heat Mass Transfer.

*Primary Examiner*—Allen J. Flanigan
*Attorney, Agent, or Firm*—Barry L. Clark

[57] ABSTRACT

Metallic tubes (10,10') for boiling have an outer surface (12) for contacting a refrigerant and an inner surface (14) for contacting a liquid heat transfer medium to be chilled. The outer surface (12) has a plurality of radially outwardly extending helical fins (18); the tube inner surface (14) has a plurality of helical ridges (16). The fins (18) of the outer surface are notched to provide nucleate boiling cavities having pores (30). The fins (18) and notches (N) are so spaced that the pores (30) have an average area less than 0.00009 square inches and a pore density of at least 2000 per square inch on the tube outer surface. The helical ridges (16) on the inner surface have a predetermined ridge height and pitch and are positioned at a predetermined helix angle, the inner surface having a severity factor Φ in the range of 0.006 to 0.008. For use with high pressure refrigerants, angled grooving or notching in one direction is preferred; for use with low pressure refrigerants, a second set of notches at an angle to the first set is preferred.

23 Claims, 15 Drawing Sheets

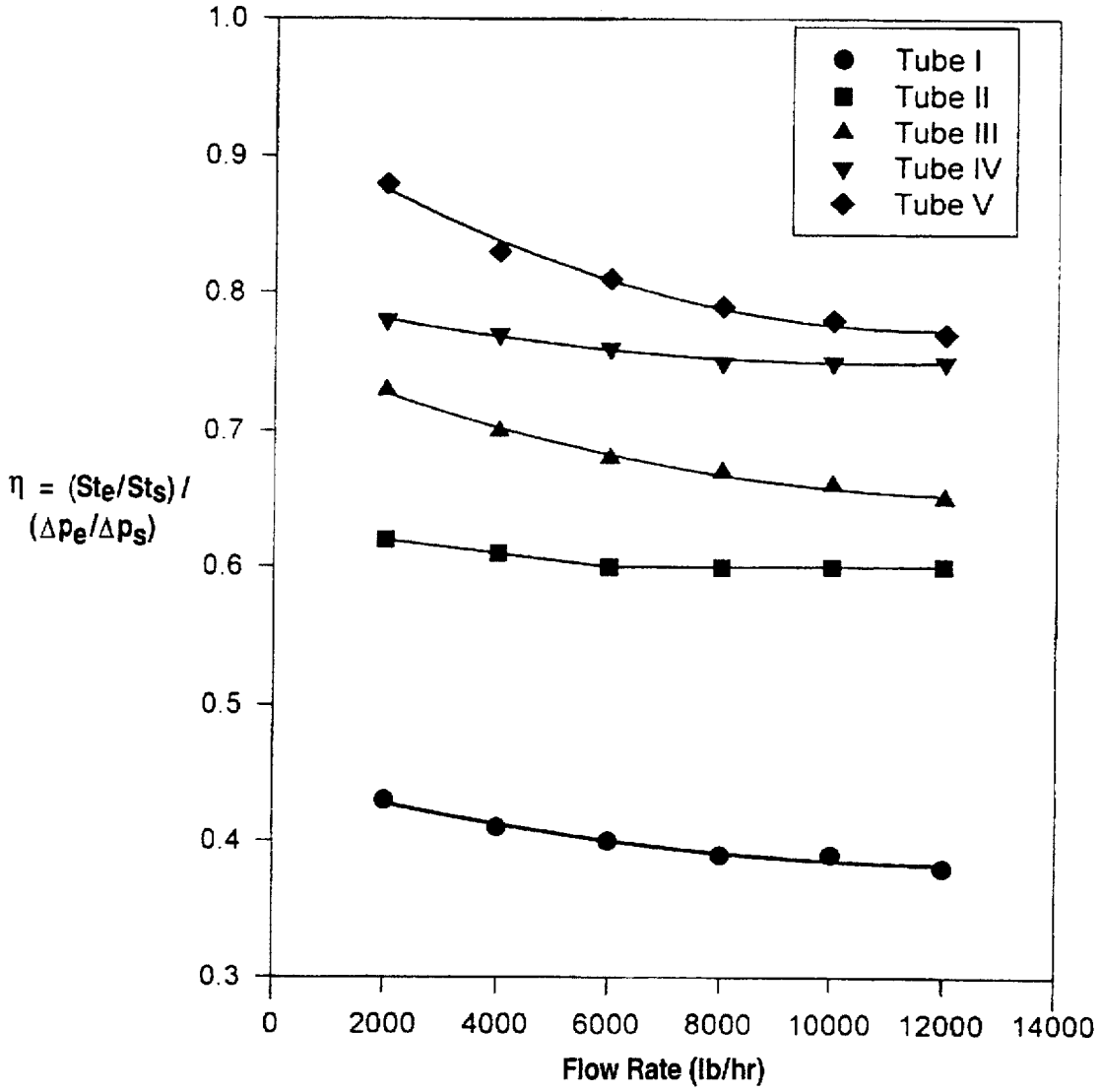
*Fig. 6* η vs. Flow Rate

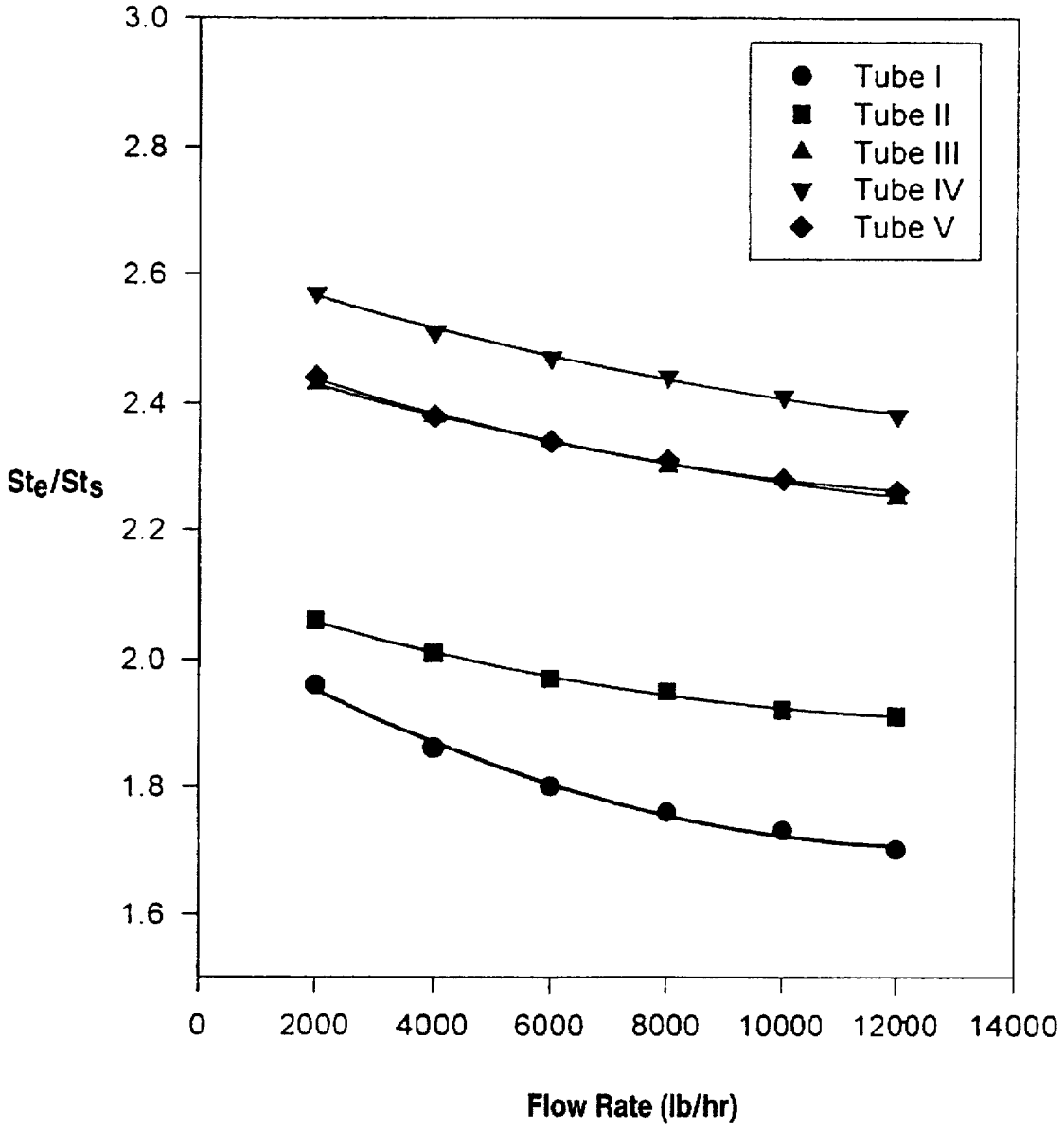
*Fig. 7* $St_e/St_s$ vs. Flow Rate

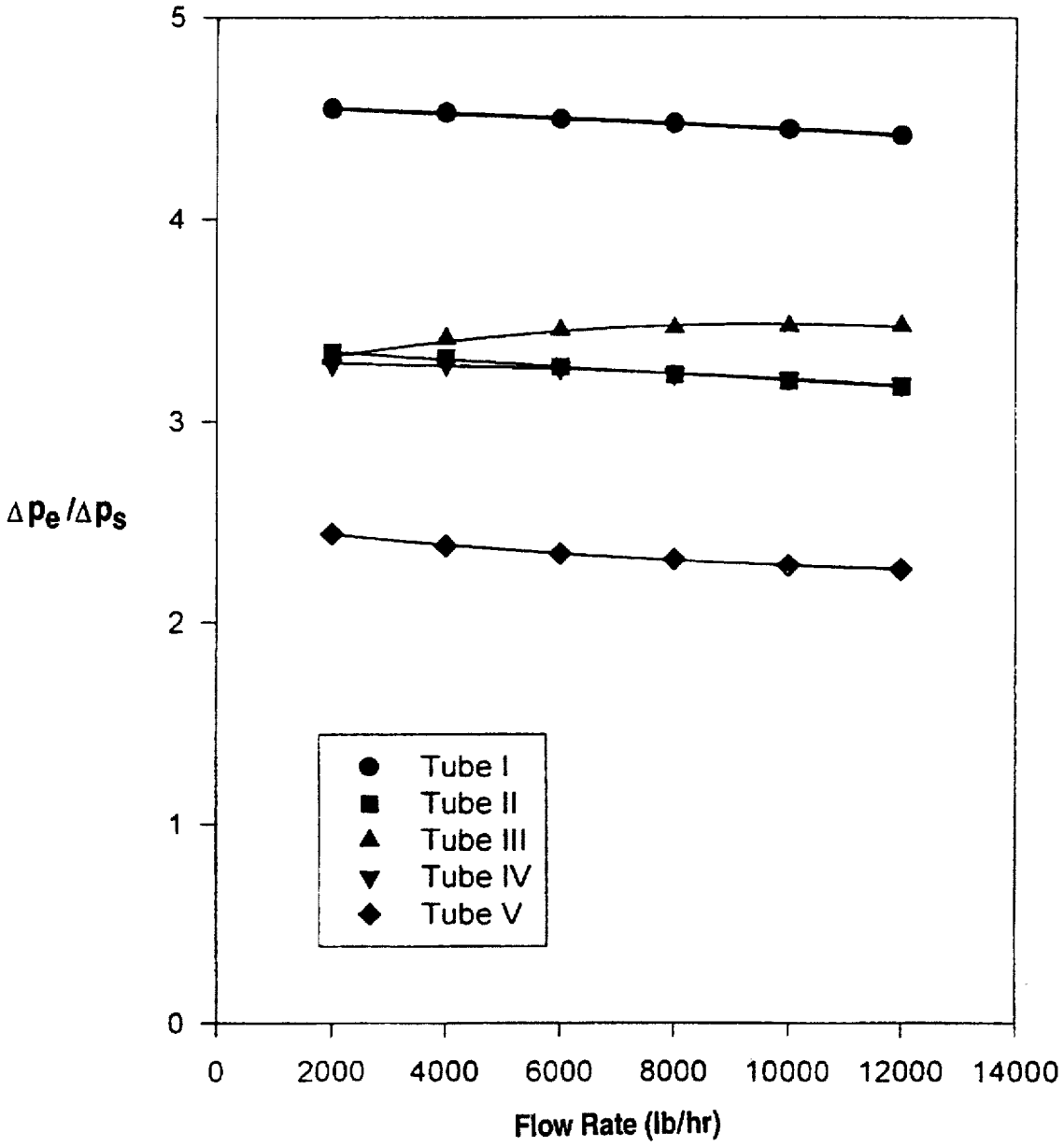
*Fig. 8* ($\Delta p_e/\Delta p_s$) vs. Flow Rate

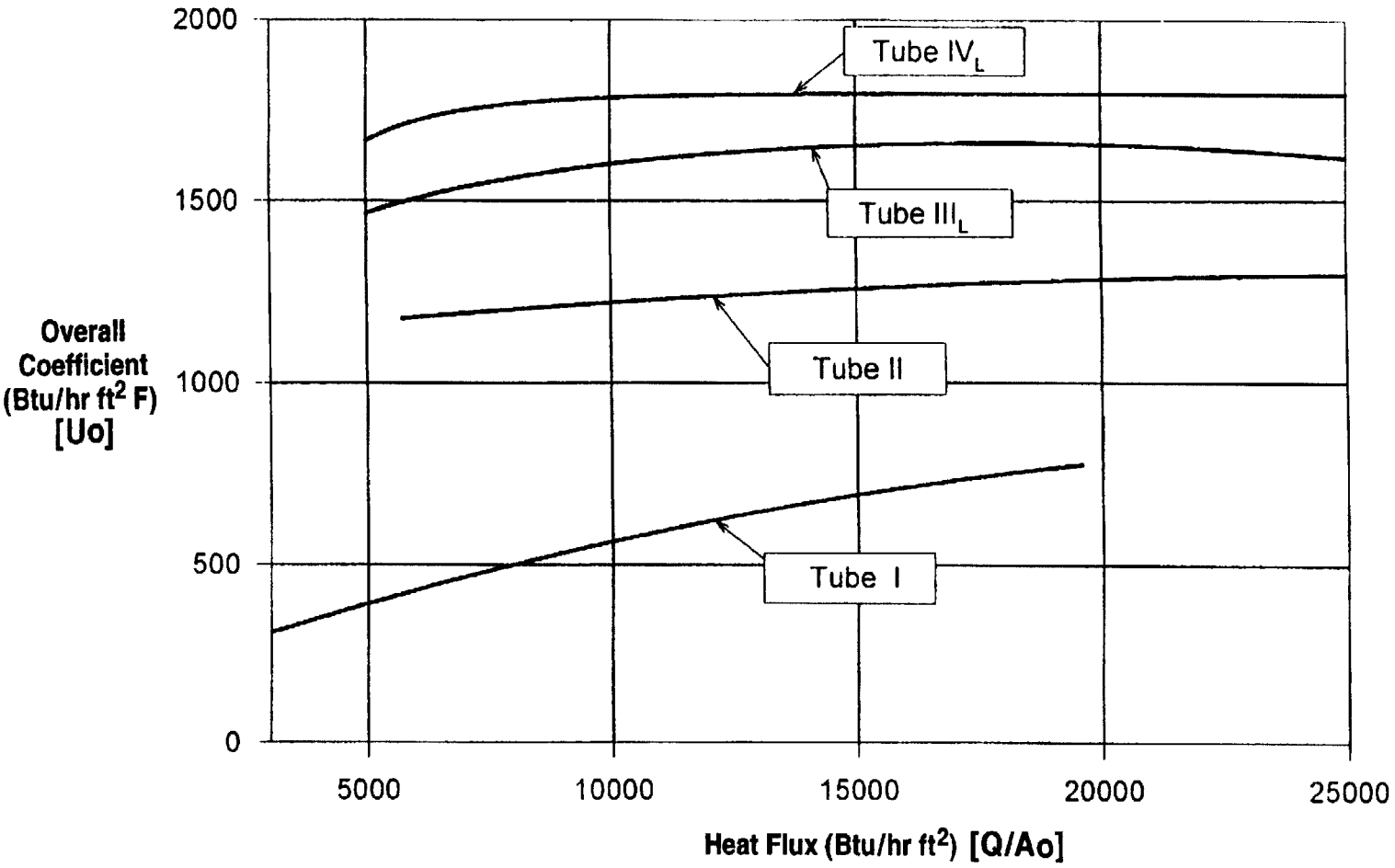
*Fig. 9* Overall Coefficient vs. Heat Flux

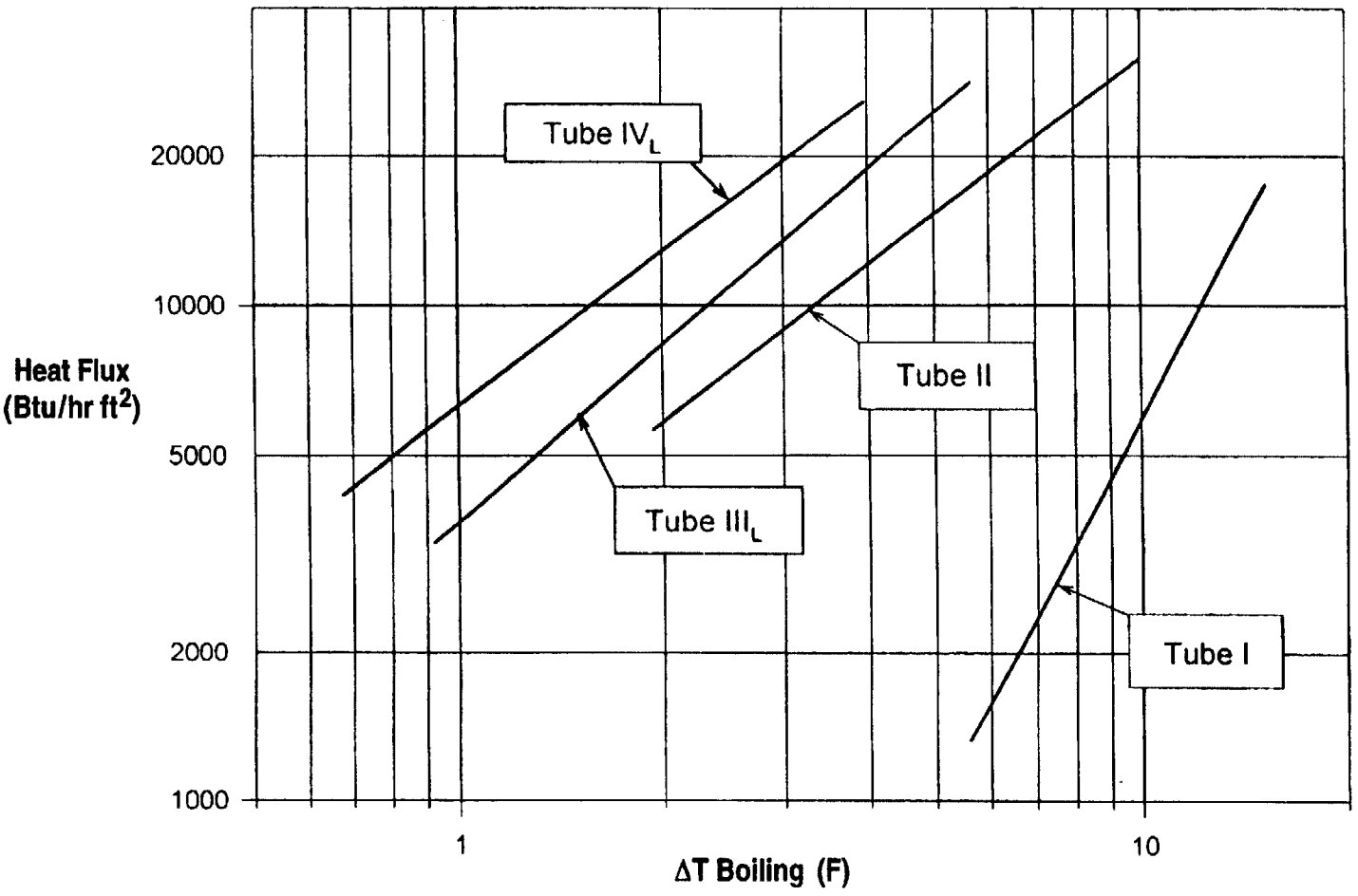
*Fig. 10* Heat Flux vs. ΔT Boiling

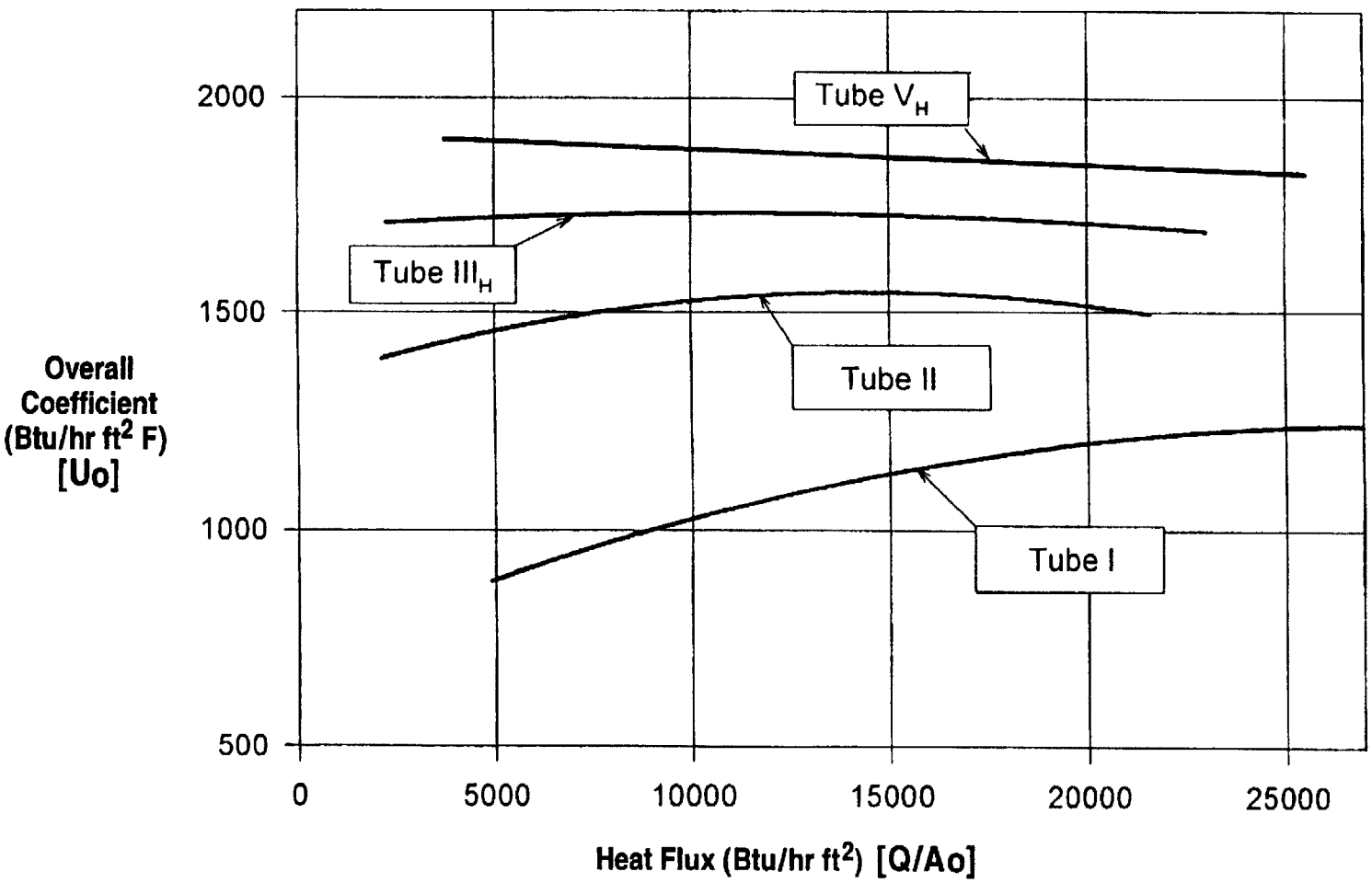
*Fig. 11* Overall Coefficient vs. Heat Flux

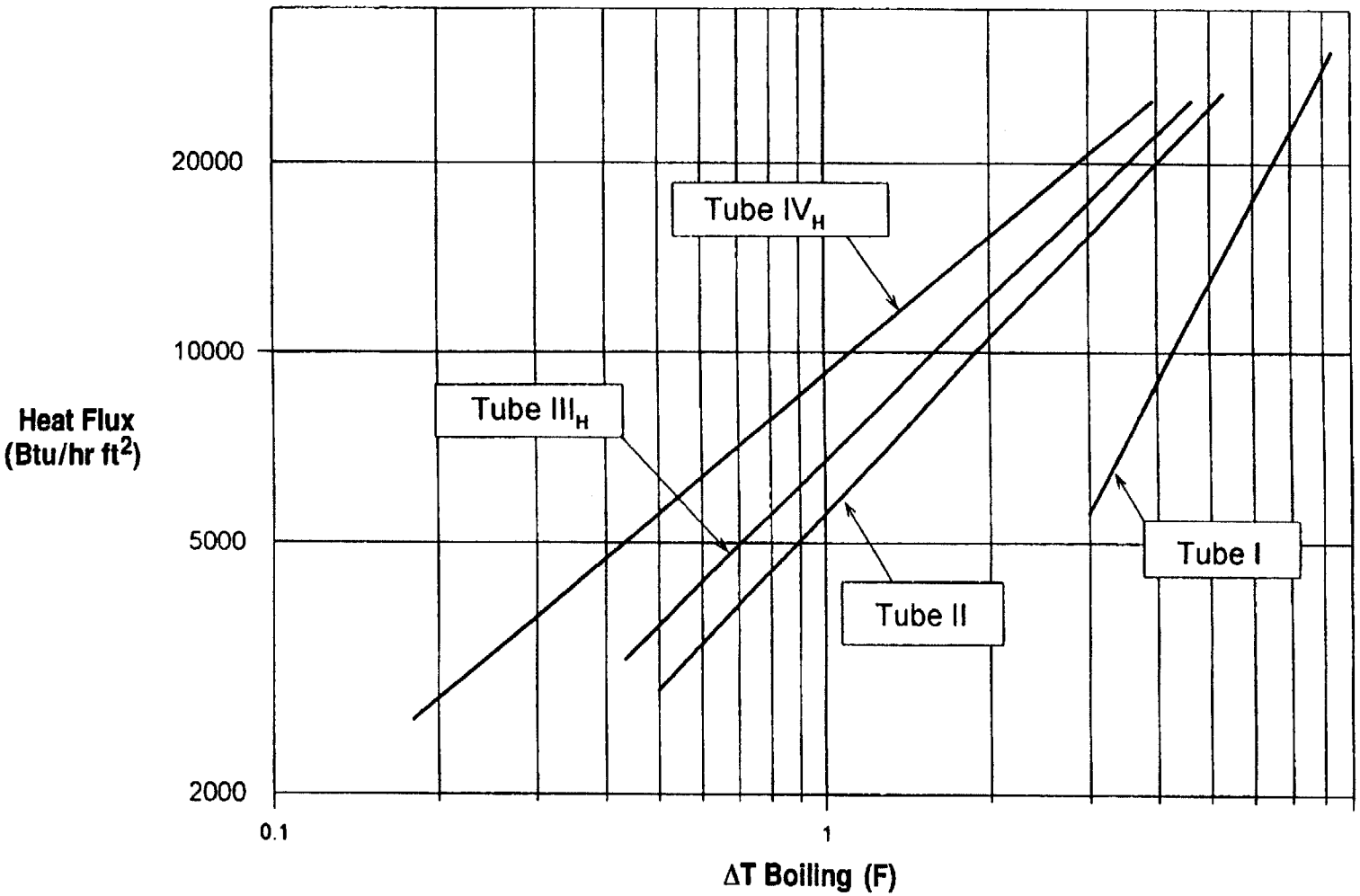
*Fig. 12* Heat Flux vs. ΔT Boiling

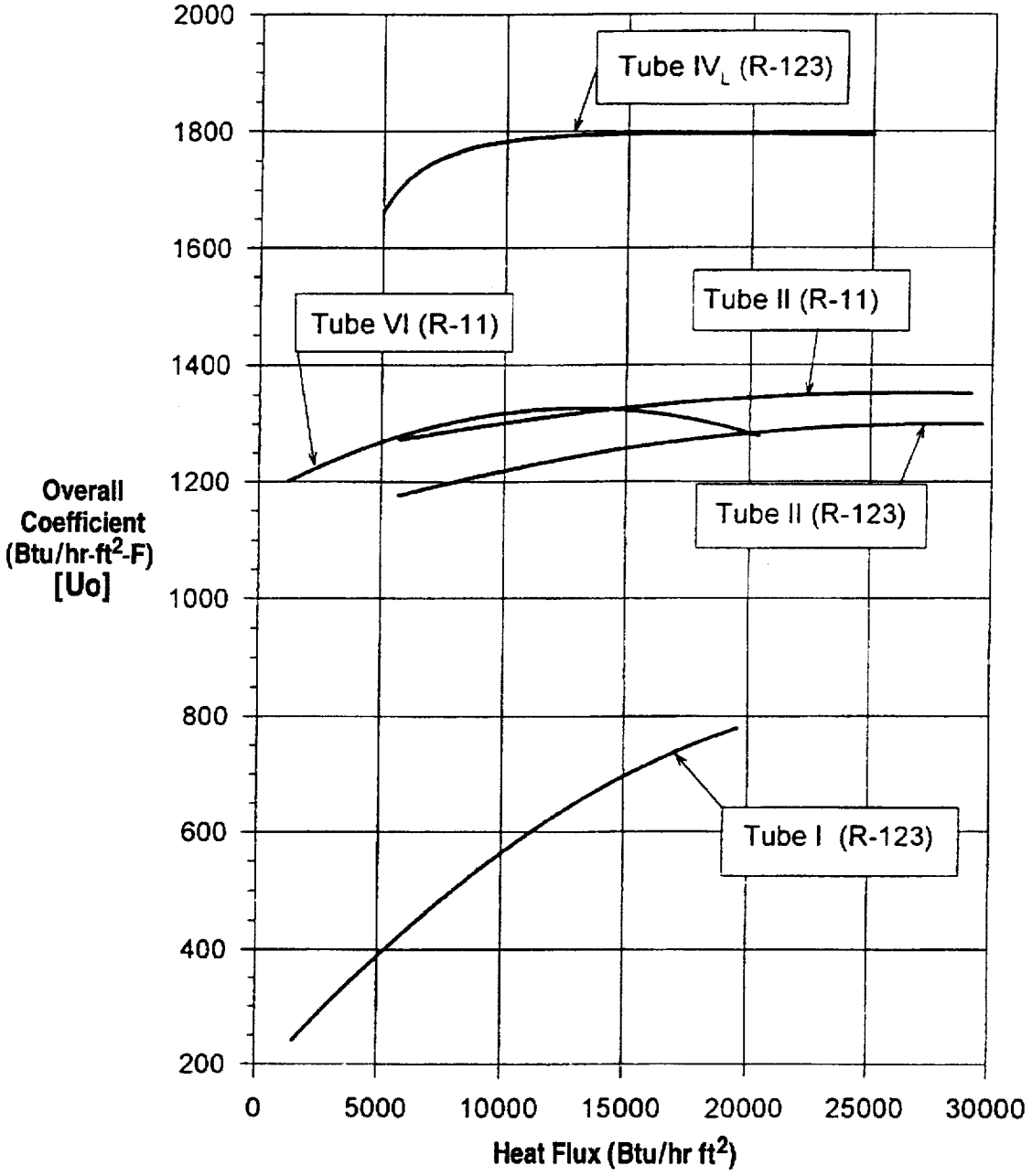
*Fig. 13* Overall Coefficient vs. Heat Flux [Q/Ao]

HEAT TRANSFER TUBES AND METHODS OF FABRICATION THEREOF

BACKGROUND

This application is a continuation-in-part of U.S. patent application Ser. No. 08/417,047 filed on Apr. 4, 1995, now abandoned, which is hereby incorporated by reference.

1. Field of Invention

This invention pertains to mechanically formed heat transfer tubes such as those employed in various boiling applications.

2. Related Art and Other Considerations

In submerged chiller refrigerating applications, the outside of the tube is submerged in a refrigerant to be boiled, while the inside conveys liquid, usually water, which is chilled as it gives up its heat to the tube and refrigerant. In a boiling application, it is desirable to maximize the overall heat transfer coefficient.

To enhance heat transfer, typically the outer surface of the tube has fins formed thereon, the fins extending (at least in part) in a direction parallel to a radius of the tube. Heat transfer has also been enhanced by modifying the inner surface of the tube, e.g., by ridges on the tube inner surface, as taught (for example) in U.S. Pat. No. 3,847,212 to Withers, Jr. et al. (incorporated herein by reference). Withers specifically relates an improved heat transfer coefficient to a ridge-dependent severity factor $\Phi=e^2/p_i d_i$ (where e is average height of a ridge, $p_i$ is the average pitch of the ridges, and $d_i$ is the maximum projected internal diameter of the tube, all measured in inches). Various tubes produced in accordance with the Withers patent have been marketed under the trademark TURBO-CHIL®.

Some heat transfer tubes have come to be referred to as nucleate boiling tubes. The outer surfaces of nucleate boiling tubes are formed to produce multiple cavities, openings or enclosures (referred to as boiling or nucleation sites and having openings known as pores) which function mechanically to permit small vapor bubbles to be formed therein. The vapor bubbles tend to form and start to grow in size before they break away from the surface. Upon breaking away, the bubbles allow additional liquid inflowing from subsurface channels to take their vacated space and start all over again to form another bubble.

U.S. Pat. No. 4,660,630 to Cunningham et al. (incorporated herein by reference) shows nucleate boiling tubes wherein such cavities are formed by notching or grooving the fins of the outer surface of the tube, the notching being in a direction essentially perpendicular to the plane of the fins. Cunningham fins a plain tube while simultaneously forming helical ridges on its inner surfaces, pressing a plurality of transverse grooves into the tips of the fins in the direction of the tube axis, and then pressing down the fin tips to produce a plurality of generally rectangular, wide, thickened head portions which are separated from each other between the fins by a narrow gap which overlies a relatively wide channel in the root area of the fins. Various tubes produced in accordance with the Cunningham et al. patent have been marketed under the trademark TURBO-B®. In another nucleate boiling tube, marketed under the trademark TURBO-BII®, the notches are formed at an acute angle to the plane of the fins.

As alluded to above, in some heat transfer tubes, the fins are rolled over and/or flattened after they are formed so as to produce narrow gaps which overlie the larger cavities or channels defined by the roots of the fins and the sides of adjacent pairs of fins. Examples include the tubes of the following United States patents (all of which are incorporated herein by reference): Cunningham et al U.S. Pat. No. 4,660,630; Zohler U.S. Pat. No. 4,765,058; Zohler U.S. Pat. No. 5,054,548; Nishizawa et al U.S. Pat. No. 5,186,252; Chiang et al U.S. Pat. No. 5,203,404; and, Liu et al U.S. Pat. No. 5,333,682.

The need for controlling the density and size of the pores of the nucleating sites has been recognized in the prior art, as well as the interrelationship between pore size and refrigerant type. U.S. Pat. No. 5,146,979 to Zohler purports to increase performance with higher pressure refrigerants by employing tubes having nucleate pores ranging in size from 0.000220 square inches to 0.000440 square inches (the total area of the pores being from 14% to 28% of the total surface area of the outer surface). Tubes marketed under the trademark TURBO-BII® as described above have pores with an average area greater than 0.0001 square inches.

As described below, Applicants have developed new geometries for heat transfer tubes and have achieved significantly improved heat transfers.

SUMMARY

Metallic tubes for boiling have an outer surface for contacting a refrigerant and an inner surface for contacting a liquid heat transfer medium to be chilled. The tube outer surface has a plurality of radially outwardly extending helical fins; the inner surface has a plurality of helical ridges. The fins of the outer surface are notched to provide nucleate boiling sites having pores. The fins and notches are so spaced to provide pores having an average area less than 0.00009 square inches and a pore density of at least 2000 per square inch of outer surface of the tube. Preferably, the pore density exceeds 3000 per square inch and is on the order of about 3112 pores per square inch. The helical ridges on the inner surface have a predetermined ridge height and pitch and are positioned at a predetermined helix angle, the inner surface having a severity factor $\Phi$ in the range of 0.006 to 0.008.

For use with high pressure refrigerants, angled grooving or notching in one direction is preferred. For use with low pressure refrigerants, a second set of notches at an angle to the first set is preferred. In some embodiments, the notching of the second set of notches in the second direction occurs at a pitch to vary the average pore size.

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

FIG. 6 is a graph comparing an efficiency index for five different heat transfer tubes.

FIG. 7 is a graph comparing the inside heat transfer performance to a smooth tube for five different types of internally ridged tubes at varying water flow rates.

FIG. 8 is a graph comparing the pressure drop of tubes I–V to that of a smooth tube for different water flow rates.

FIG. 9 is a graph comparing the overall heat transfer coefficient Uo in refrigerant HCFC-123 at varying heat fluxes, Q/Ao.

FIG. 10 is a graph of heat flux vs. boiling temperature difference in refrigerant HCFC-123.

FIG. 11 is a graph comparing the overall heat transfer coefficient Uo in refrigerant HFC-134a at varying heat fluxes, Q/Ao.

FIG. 12 is a graph of heat flux vs. boiling temperature difference in refrigerant HFC-134a.

FIG. 13 is a graph comparing the overall heat transfer coefficient Uo at varying Heat Fluxes, Q/Ao and specifically showing the relationship between Tube VI to tubes I, II and $IV_L$.

DETAILED DESCRIPTION OF THE DRAWINGS

Figure 1:
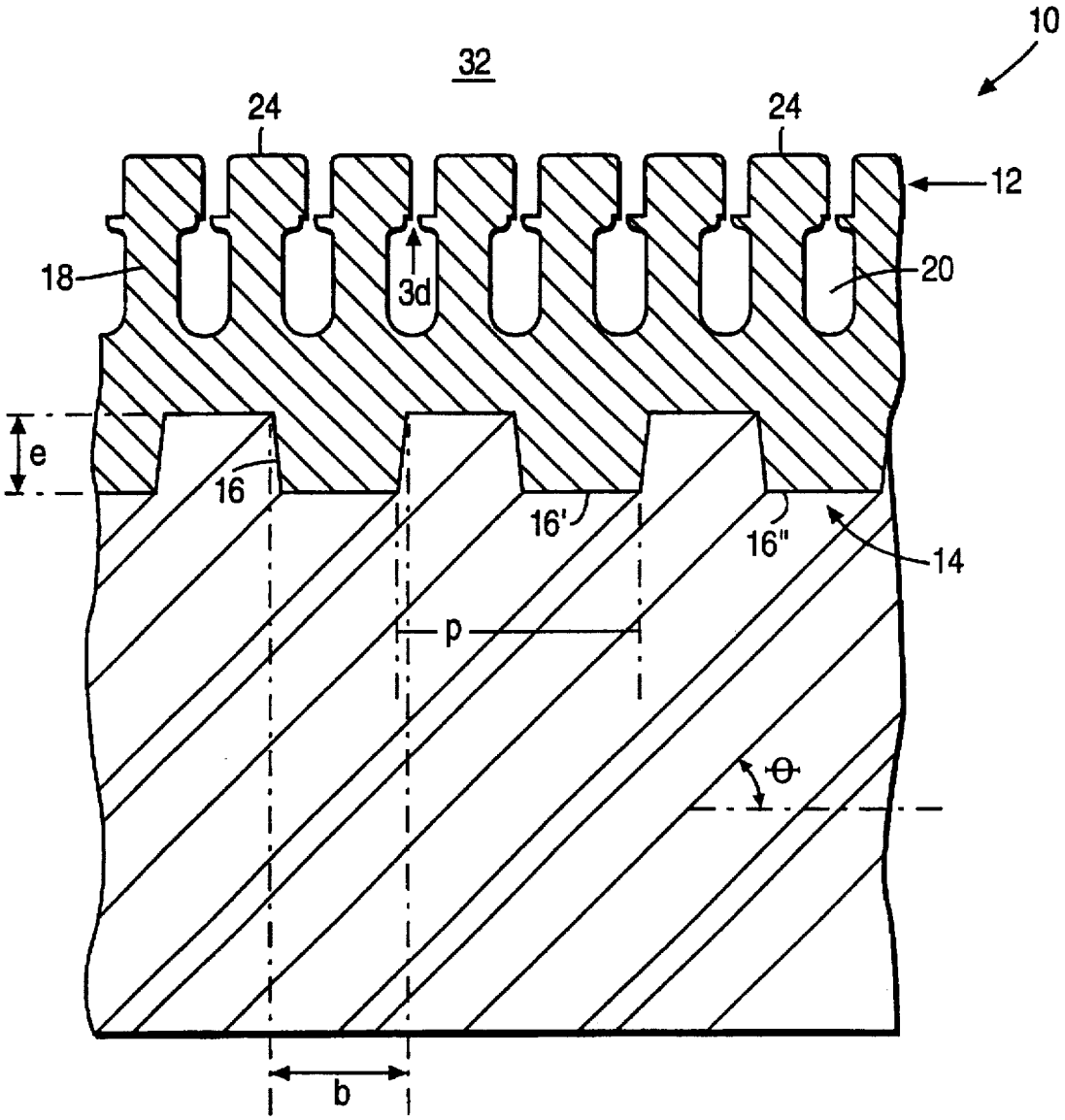
FIG. 1 is an enlarged, partially broken away axial cross-sectional view of a tube according to an embodiment of the invention.

Referring to FIG. 1, an enlarged fragmentary portion of one embodiment of an improved tube 10 of the present invention is shown in axial cross-section. The tube 10 comprises a deformed outer surface indicated generally at 12 and a ridged inner surface indicated generally at 14. Tube 10 of the FIG. 1 embodiment has a nominal outer diameter of ¾ inches. It should be understood that principles of the invention are applicable to tubes of other nominal outer diameters, such as the common 1 inch and ⅝ inch sizes, for example.

Inner surface 14 of tube 10 comprises a plurality of ridges, such as ridges 16, 16', 16" (generically referred to as ridges 16). Ridges 16 have their pitch "p", their ridge width "b" (as measured axially at the ridge base), and their average ridge height "e" measured as indicated by correspondingly alphabetized dimension arrows shown in FIG. 1. The helix lead angle "θ" is measured from the axis of the tube.

U.S. Pat. No. 3,847,212 to Withers, Jr. (referenced above and incorporated herein by reference) taught the use of a relatively low number of ridge starts, such as 6, arranged at a relatively large pitch, such as 0.333 inch, and at a relatively large angle to the axis, such as 51 degrees. A tube marketed under the trademark TURBO-BII® had 38 ridge starts.

In contrast, tube 10 shown in FIG. 1 has 34 ridge starts, a pitch of 0.0516 inch, and a ridge helix angle of 49 degrees. The parameters of tube 10 enhance the inside heat transfer coefficient by providing, e.g., increased surface area and also permitting the fluid inside tube 10 to swirl as it traverses the length of tube 10. At the ridge angles which are preferred, the swirling flow tends to keep the fluid in good heat transfer contact with the inner surface 14 but avoids excessive turbulence which could provide an undesirable increase in pressure drop. The foregoing is reflected by the efficiency index η for tubes IV and V in FIG. 6 as discussed below.

Thus, helical ridges 16 on the tube inner surface 14 have a predetermined ridge height and pitch and are positioned at a predetermined helix angle. In fact, in terms of the dimensionless evaluation factor set forth in U.S. Pat. No. 3,847,212 to Withers et al., tubes IV and V have a severity factor Φ in the range of 0.006 to 0.008, where $\Phi=e^2/p_i d_i$, it being understood that e is the average ridge height in inches; $p_i$ is the average pitch of the helical ridges in inches; and $d_i$ is the maximum inner diameter of the tube in inches.

Outer surface 12 of tube 10 is formed to have a plurality of fins 18 provided thereon. Fins 18 are formed on a conventional arbor finning machine in a manner understood with reference to U.S. Pat. No. 4,729,155 to Cunningham et al., for example. The number of arbors utilized depends on such manufacturing factors as tube size, throughput speed, etc. The arbors are mounted at appropriate degree increments around the tube, and each is preferably mounted at an angle relative to the tube axis. The finning disks form a plurality of adjacent, generally circumferential, relatively deep channels 20 (i.e., first channels), as shown in FIG. 2A, for example.

Figure 2A:
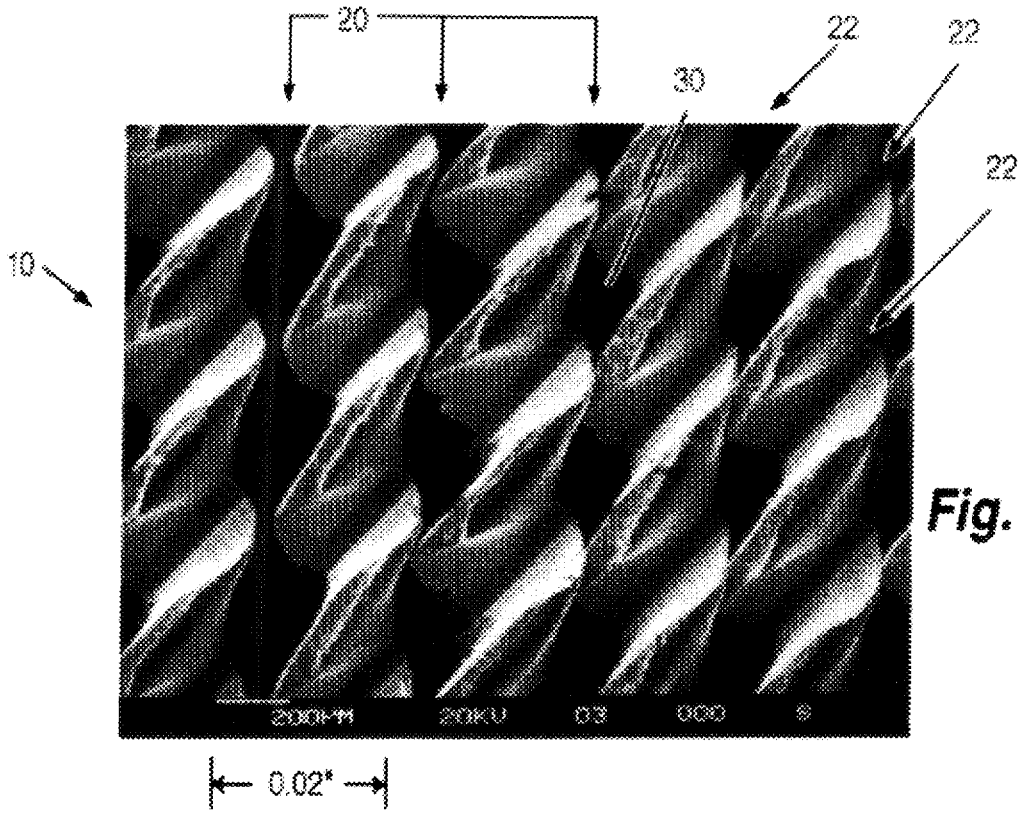
FIG. 2A is a 50X photomicrograph of an outer surface of a single direction notched tube subsequent to notching but prior to fin-flattening.
Figure 4:
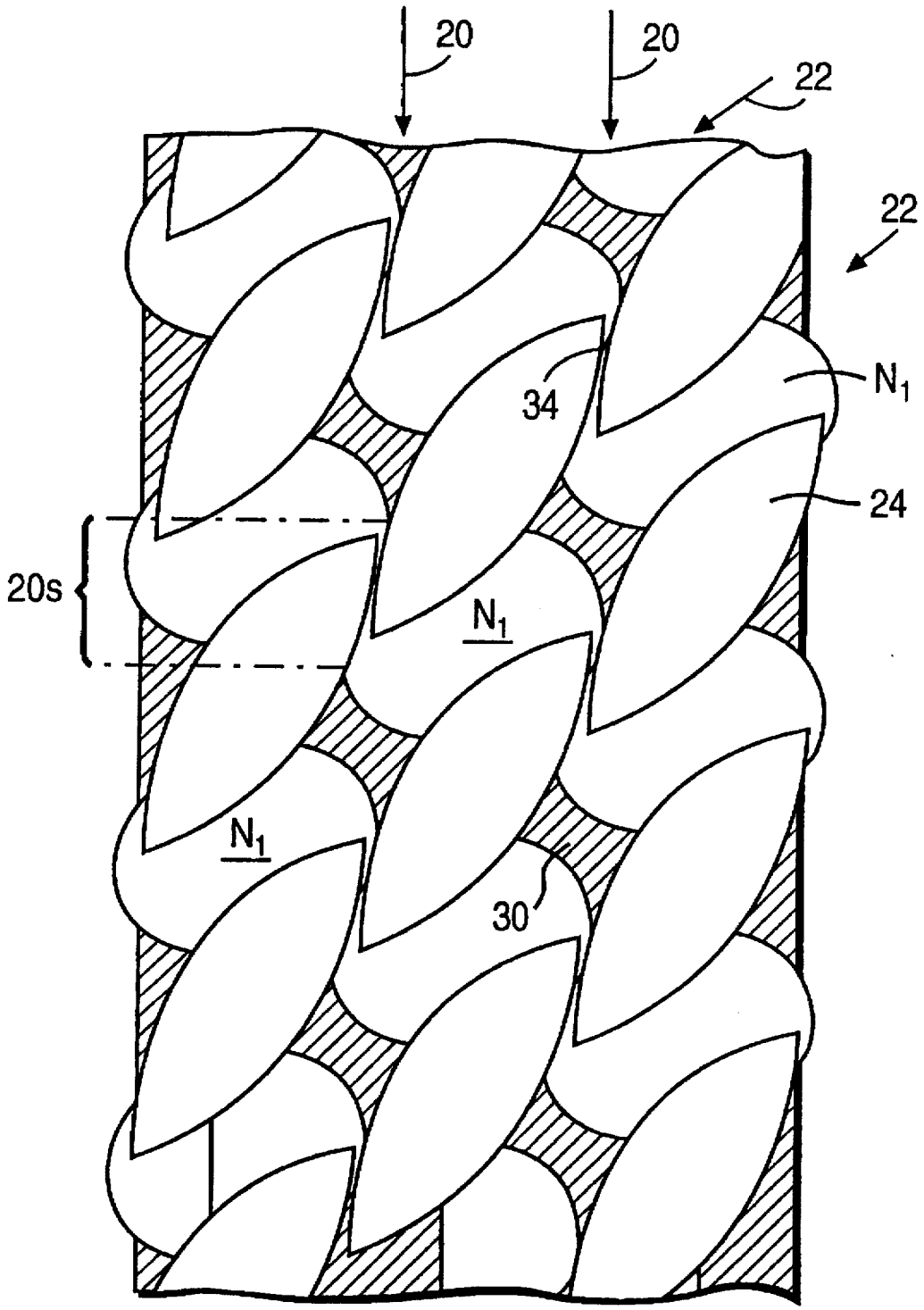
FIG. 4 is a schematic depiction of the outer surface of the tube of FIG. 2B.

After fin formation, outer surface 12 of tube 10 is notched to provide a plurality of relatively shallow channels 22 (e.g., second channels) [see FIG. 2A and FIG. 4, for example]. The notching is accomplished using a notching disk (also understood with reference to U.S. Pat. No. 4,729,155 to Cunningham et al.). As shown in FIG. 2A, channels 22 interconnect adjacent pairs of channels 20 and are positioned at an angle to the channels 20.

The set of notches forming channels 22 is known herein as the first set of notches $N_1$. The plurality of fins 18 are circumferentially notched so that the first set of notches are arranged at angles which are in the range of the first set of notches $N_1$ are spaced around a circumference of each fin 18 at a pitch which is preferably in a range of between 0.0161 to 0.03 (as measured along the circumference of fin 18 at a base of the notches), and more preferably in a range of 0.020 inches to 0.025 inches.

After notching (also known as grooving), fins 18 are compressed using a compression disk (also understood with reference to U.S. Pat. No. 4,729,155 to Cunningham et al.) resulting in flattened fin heads 24. The appearance of tube outer surface 12 after compression with flattened fin heads is shown, for example, in FIG. 2B.

A typical notch depth, into the fin tip, before any flattening is performed, is about 0.015 inches. After flattening, the depth measured from the final outside surface is about 0.005 inches. Notches of the first set of notches $N_1$ are spaced around a circumference of each fin 18 at a pitch which is preferably in a range of between 0.0161 to 0.03 (as measured along the circumference of fin 18 at a base of the notches), and more preferably in a range of 0.020 inches to 0.025 inches. Adjacent notches are thus non-contiguously spaced apart so that a flattened fin 24 is intermediate neighboring pores 30.

Returning to FIG. 2A, pores 30 are shown at the intersection of channels 20 and channels 22 at the bottom of channels 22. Each pore 30 has a pore size, which is the size of the opening from the boiling or nucleation site from which vapor escapes to refrigerant bath 32. Fins 18 are so spaced, and channels 22 so formed, whereby pores 30 have an average area less than 0.00009 square inches. Preferably, the pore average sizes for tube 10 are between 0.000050 square inch and 0.000075 square inch. Pores 30 have a density of at least 2000 per square inch of tube outer surface 12. Preferably, the pore density exceeds 3000 per square inch and is on the order of about 3112 pores per square inch. The number of pores per square inch depends somewhat on tube wall thickness under the fins. With the preferred 3112 number of pores, for example, a wall thickness of 0.025 inches is present. If one makes a tube with a 0.035 inch or heavier wall, the fin count tends to increase. In referring to pore average area, it is recognized that fabrication techniques such as finning may result in some pore sizes being greater than 0.00009 square inch. However, the vast majority of the pores have an average area less than 0.00009 square inches.

Figure 2B:
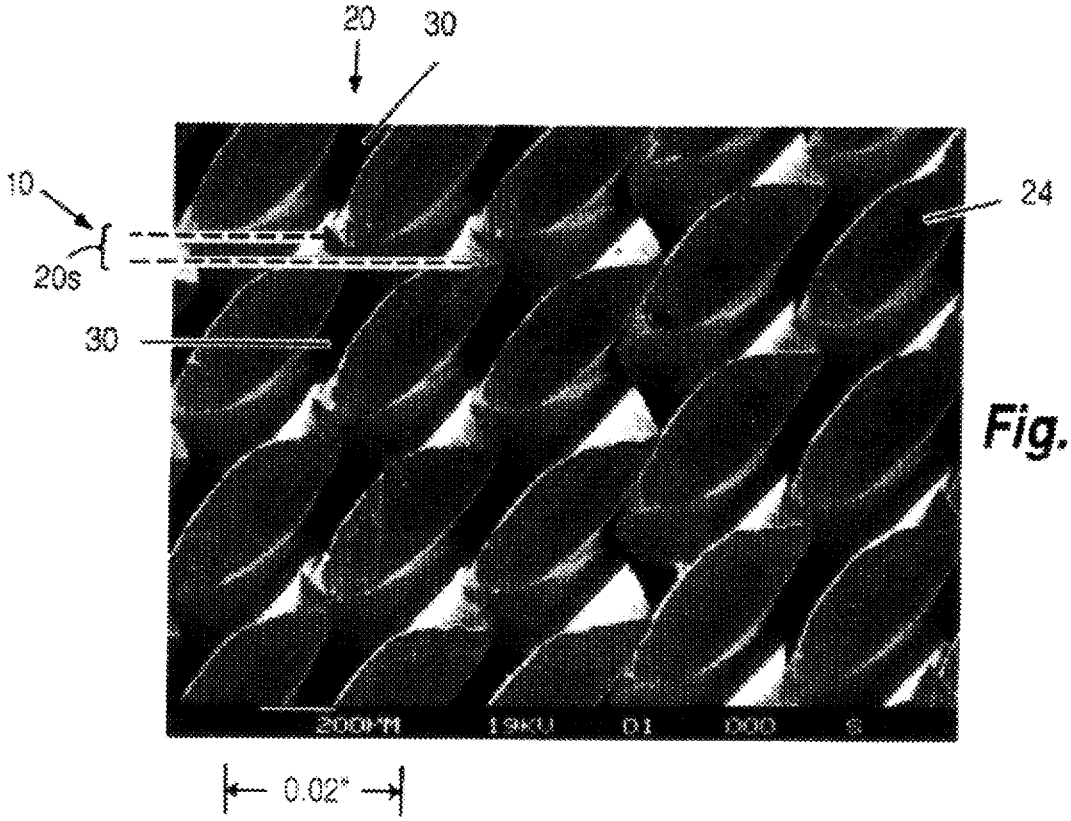
FIG. 2B is a 50×photomicrograph of the outer surface of the tube of FIG. 2A subsequent to fin-flattening.

The spacing of fins 18 of tube 10 of FIG. 2B is 61 fins per inch. That is, the plurality of helical fins 18 are axially spaced at a pitch less than 0.01754 inch (i.e., more than 57 fins/in), and preferably less than 0.01667 inch (i.e., more than 60 fins/in).

Factors such as the notch pitch and number of fins per inch influence the number of pores per square inch on the outside surface, in accordance with the following relationship:

$$N_o=(\pi*D_o*FPI)/(N_p*\pi*D_o)=FPI/N_p$$

in which $D_o$ is the outside diameter of the tube; FPI is the number of pins per inch; and $N_p$ is the notch disc pitch.

Thus, tube 10 has mechanical enhancements which can individually improve either the tube outer surface 12 or the tube inner surface 14, or which can cooperate to increase the overall efficiency. The tube internal enhancement, which is useful on either boiling or condensing tubes, comprises the plurality of closely spaced helical ridges 16 which provide increased surface area and are positioned at an angle which gives them a tendency to swirl the liquid. The tube external enhancement, which is applicable to boiling tubes, is provided by successive grooving and compression operations performed after finning. The finning operation, in a preferred embodiment for nucleate boiling, produces fins 18 while the grooving (e.g., notching) and compression cooperate to flatten tips of fins 18 and cause tube outer surface 24 to have the general appearance of a grid of generally flattened ellipses. Between pores 30, underneath flattened tips of fins 18, each channel 20 has a channel segment 20s (see FIG. 2B and FIG. 4) which is enclosed from above by the flattened tips of fins 18. The flattened ellipses are wider than precompressed fins 18 and separated by narrow openings 34 between fins 18 and narrow grooves (e.g., channels 20) at an angle thereto. The roots of fins 18 and cavities or channels 20 formed therein under the flattened fin tips 24 are of greater width than the nucleation pores 30, so that vapor bubbles can be formed at nucleation sites in the cavities (e.g, beneath pores 30) and then travel outwardly from cavities formed by channels 20 and to and through the narrow openings 30. Pores 30 are shown in FIG. 2A, and also shown (partially covered by notched and flattened fins) in FIG. 2B and FIG. 4. The cavities and narrow openings and the grooves all cooperate as part of a flow and pumping system so that the vapor bubbles can be formed and readily carried away from the tube and so that fresh liquid can circulate to the nucleation sites. The rolling operation is performed in a manner such that the cavities produced will be in a range of sizes with a size distribution predominately of the optimum size for nucleate boiling of a particular fluid under a particular set of operating conditions.

Figure 3A:
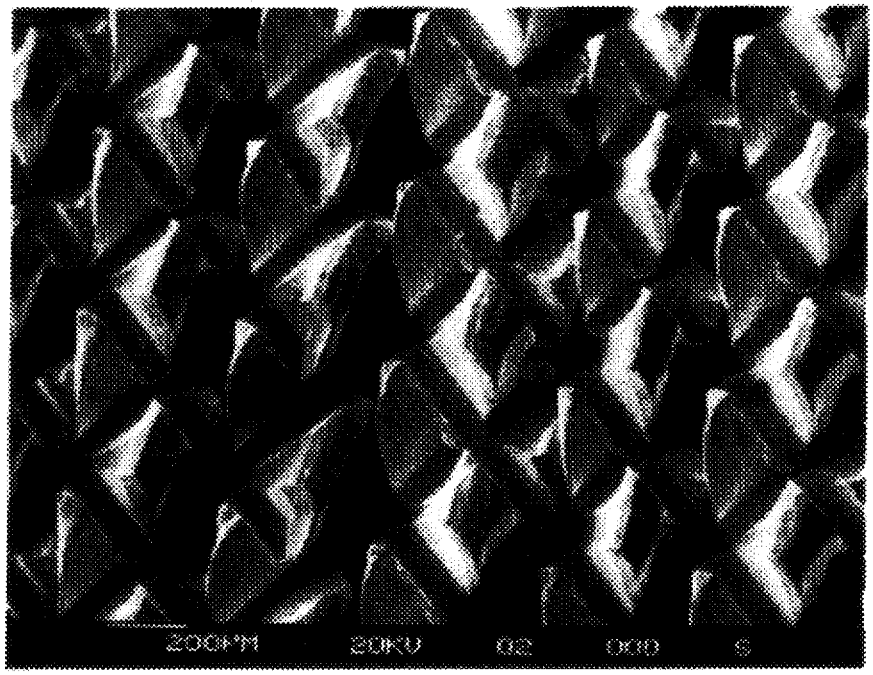
FIG. 3A is a 50×photomicrograph of an outer surface of a double direction notched tube subsequent to notching but prior to fin-flattening.
Figure 3B:
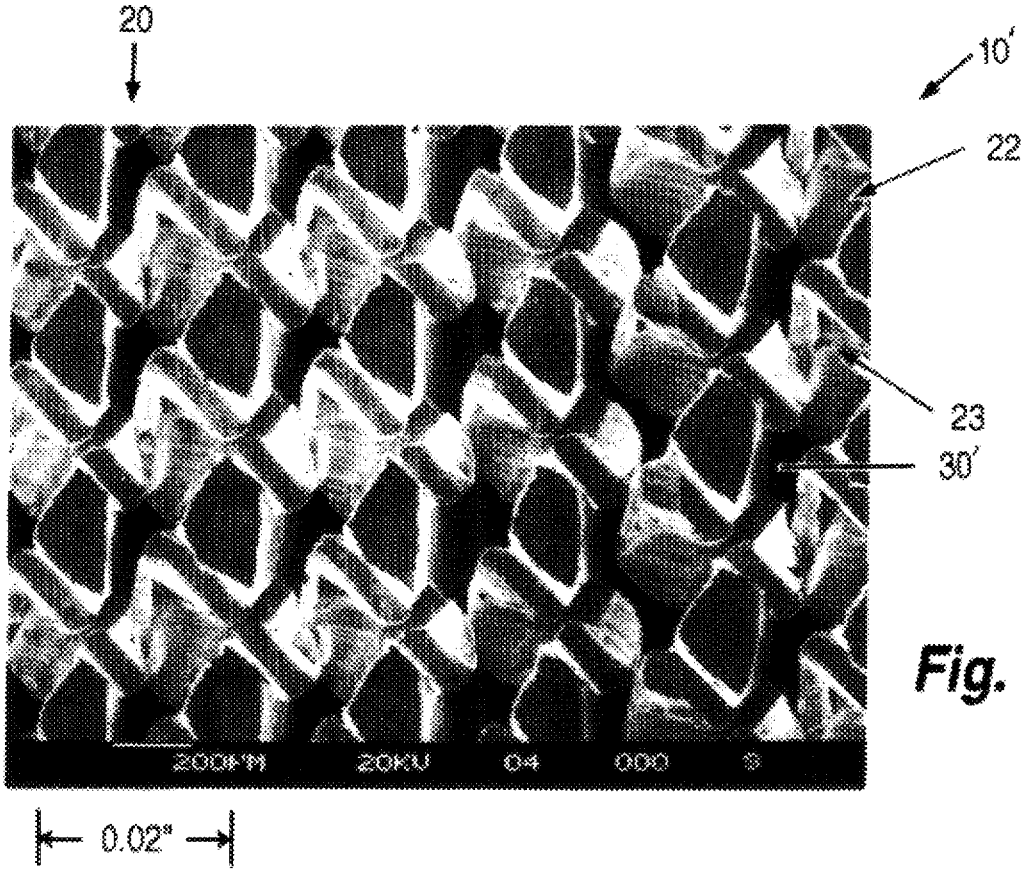
FIG. 3B is a 50×photomicrograph of the outer surface of the tube of FIG. 3A subsequent to fin-flattening.

FIG. 3A and FIG. 3B show another tube embodiment (tube 10') wherein, after a first notching operation to provide a first set of notches $N_1$ (yielding channels 22), a second notching operation is conducted to provide a second set of notches $N_2$ (to yield channels 23). The second set of notches $N_2$ overlies portions of the first set of notches $N_1$, the second set of notches $N_2$ being positioned at an angle in the range of 0°–90° relative to the plane of fins 18. The second set of notches $N_2$ is also referred to as cross notches. Notches $N_1$ have a notch pitch $NP_1$; notches $N_2$ have a notch pitch $NP_2$. Notch pitch $NP_1$ differs from notch pitch $NP_2$.

Figure 5:
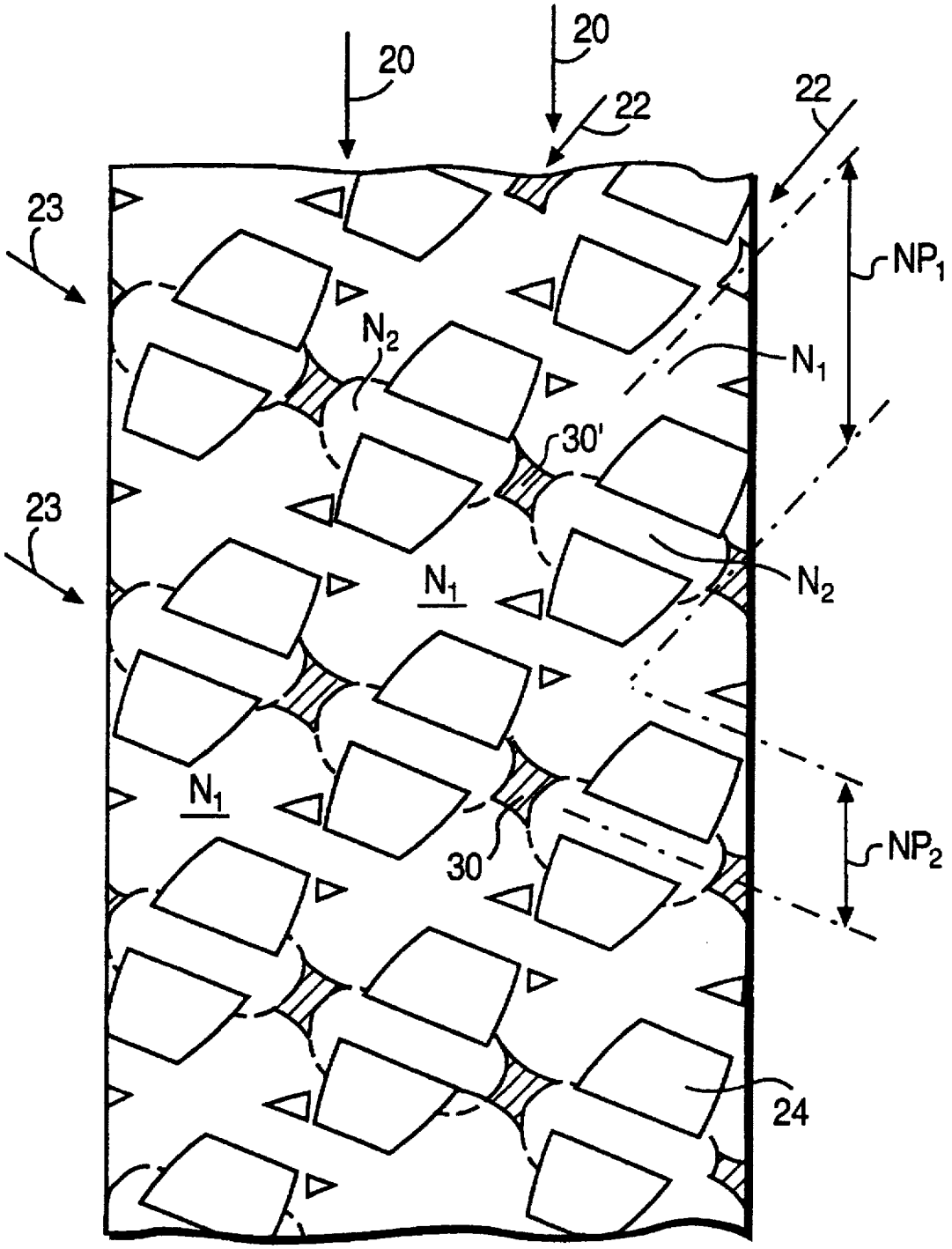
FIG. 5 is a schematic depiction of a double direction-notched tube, but with a second set of notches being formed at a different angle and pitch than a first set of notches.
Figure 5A:
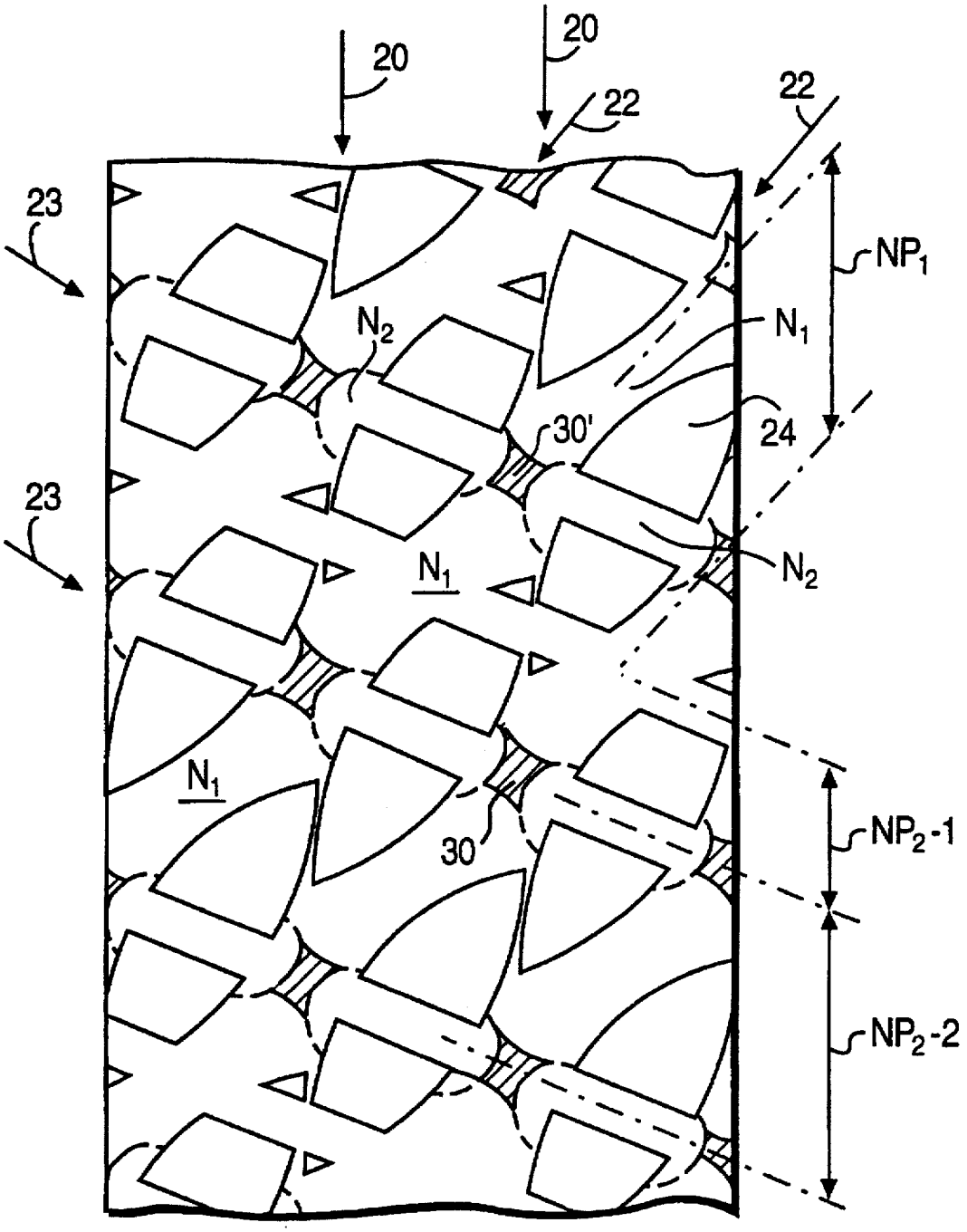
FIG. 5A is a schematic depiction of a double direction-notched tube, but with a second set of notches being formed at a pitch to vary the average pore size.

FIG. 4 and FIG. 5 are schematic depictions of the tube outer surfaces of tubes 10 and 10', respectively, subsequent to compression of fins 18. FIG. 4 shows the single notched tube 10 (having only notches $N_1$), while FIG. 5 shows the cross-notched tube 10' (having both the first notches $N_1$ and the second [cross] notches $N_2$). FIG. 5A shows a variation in pitch $NP_2$–1 and pitch $NP_2$–2. Material moved by cross notching $N_2$ is shown bordered by broken lines in FIG. 5. Although FIG. 4 and FIG. 5 do not show pores 30 and 30' in their entirety, it can nevertheless be seen in comparison that the cross notching of tube 10' of FIG. 3A and FIG. 3B results in the formation of pores 30' of even smaller cross sectional area than pores 30 of FIG. 2A. Relative to pores 30 as shown in FIG. 4, the size of pores 30' as shown in FIG. 5 is reduced as a result of the cross notching since additional metal from the fin tips is displaced inwardly (into a space between the fins) after the first notching operation. In particular, pores 30' of tube 10' have average cross sectional areas of between 0.00002 and 0.000065 square inch. Tube 10' of FIG. 3A and FIG. 3B is particularly good for low pressure refrigerants, such as HCFC-123.

In FIG. 3A and FIG. 3B, the second notching pattern does not increase the number of openings or pores 30', but does decrease the size of each pore 30' (to about half of the original [i.e., single notch] pore size). Where some second notching patterns increase the variability of the pores, such notching patterns also tend to increase the number of cavities in areas where the notch disc splits the original single notch opening in at least two parts (not necessarily of equal size).

Of the tubes described herein, tube outer surface 12 is effective for use with particular refrigerants such as the alternative non-CFC refrigerants, including the high pressure refrigerant HFC-134A and the low pressure refrigerant HCFC-123.

In order to allow a comparison of the improved tubes of the present invention including tubes 10 and 10' to various known tubes, Tables I and II are provided to describe various tube parameters and performance results, respectively. The tubes evaluated are identified in Table 1. Table 2 describes dimensional characterstics of tubes listed in Table 1. As noted in Table 1, a reference to Tube IV or Tube V refers to a tube having the internal configuration described in Table 2 for the respective columns entitled as Tube IV and Tube V.

Table 3 compares inside performance of tubes I, II, and III to tubes IV and V. All tubes are compared at constant tube side water flow rate of 5 GPM and a constant average water temperature of 50° F. Comparisons in Table 3 are based on nominal ¾ inch outside diameter tubes.

Considering Table 3, tube I has a inside Sieder and Tare constant of Ci=0.052 compared to a smooth bore constant of typically $Ci_p$=0.027. Tube II was designed to provide a significant increase in both inside and outside performance. The outside performance of Tube II was increased by carefully forming fins in such a way as to create high performing nucleation sites which increased boiling performance by 445 percent. Also the inside performance of Tube II increased by 15.4% over tube I.

Table 4 compares outside performances of Tubes I, II, $III_L$ and $III_H$ to tubes $IV_L$, $IV_H$ $V_L$ and $V_H$. All tubes are eight feet long and each is separately suspended in a pool of refrigerant HCFC-123 or HFC-134a which is held at a saturation temperature of 58.3 degrees Fahrenheit. The water flow rate is held constant at 5.3 ft/s and the inlet water temperature is such that the average heat flux for all tubes is held at 7000 Btu/hr $ft^2$ which is constant. All tubes are nominal ¾ inch O.D and have the same wall thickness and are made of copper material. All tests are performed without any oil present in the refrigerant.

TABLE 1

TUBE IDENTIFICATIONS

| TUBE NO. | TUBE DESCRIPTION |
|---|---|
| TUBE I | A tube produced in accordance with the U.S. Pat. No. 3,847,212 to Withers and marketed under the trademark TURBO-CHIL ®. |
| TUBE II | A tube produced in accordance with the U.S. Pat. No. 4,660,630 to Cunningham et al. and marketed under the trademark TURBO-B ®. |
| TUBE $III_H$ | A tube marketed under the trademark TURBO-BII ®. |
| TUBE $III_L$ | A tube marketed under the trademark TURBO-BII ®. |
| TUBE $IV_H$ | Tube IV inner surface (as described in Table 2) with outer surface of tube 10 of FIG. 2A and 2B of the present invention. |
| TUBE $IV_L$ | Tube IV inner surface (as described in Table 2) with outer surface of tube 10' of FIG. 3A and 3B of the present invention. |
| TUBE $V_H$ | Tube V inner surface (as described in Table 2) with outer surface of tube 10 of FIG. 2A and 2B of the present invention. |
| TUBE $V_L$ | Tube V inner surface (as described in Table 2) with outer surface of tube 10' of FIG. 3A and 3B of the present invention. |
| TUBE VI | The tube of U.S. Pat. No. 5,146,979 (FIG. 9) |
| TUBE VII | Tube VI is a tube similar to tube III but with a different inside configuration which provides a severity factor of $\Phi$ = 0.0132; 40 internal starts; e = 0.022"; $p_i$ = .058"; $d_i$ = 0.632". |

TABLE 2

DIMENSIONAL CHARACTERISTICS OF COPPER TUBES HAVING MULTIPLE-START INTERNAL RIDGING

| TUBE DESIGNATION | I | II | III | IV | V |
|---|---|---|---|---|---|
| PRODUCT NAME | Turbo-Chil ® | Turbo-B ® | Turbo-BII ® | Turbo-BIII ™ | Turbo-BIII ™ LPD |
| FPI = fins per inch (fpi) | 40 | 40 | 50 | 60 | 60 |
| posture of fins | Erect | Mangled | Mangled | Mangled | Mangled |
| FH = Fin Height (inches) | .052 | .024 | .027 | .0215 | .0215 |
| Ao = True Outside Area, ($ft^2$/ft) | 0.864 | Unknown | Unknown | Unknown | Unknown |

TABLE 2-continued

DIMENSIONAL CHARACTERISTICS OF COPPER TUBES HAVING MULTIPLE-START INTERNAL RIDGING

| TUBE DESIGNATION | I | II | III | IV | V |
|---|---|---|---|---|---|
| $d_i$ = Inside Diameter (inches) | .573 | .632 | .632 | .645 | .645 |
| e = Ridge Height (inches) | .015 | .022 | .015 | .016 | .0145 |
| p = Axial Pitch of Ridge (inches) | .168 | .093 | .042 | .0516 | .0516 |
| $N_{RS}$ = Number of Ridge Starts | 10 | 30 | 38 | 34 | 34 |
| I = Lead (inches) | 1.68 | 2.79 | 1.72 | 1.76 | 1.76 |
| θ = Lead Angle of Ridge from Axis (°) | 46.5 | 33.5 | 49 | 49 | 49 |
| b = Ridge Width Along Axis (inches) | .051 | .068 | .032 | .0265 | .0265 |
| b/p | .306 | .731 | .786 | .514 | .514 |
| $\phi = e^2/pd_i$ = Severity Factor | 0.00234 | 0.00823 | 0.00848 | 0.00769 | 0.00632 |

TABLE 3

TUBE SIDE PERFORMANCE CHARCTERISTICS OF EXPERIMENTAL COPPER TUBES HAVING MULTIPLE START INTERNAL RIDGING

| Tube Identification | I | II | III | IV | V |
|---|---|---|---|---|---|
| u = Intube Water Velocity (ft/s) | 6.17 | 5.09 | 5.09 | 4.89 | 4.89 |
| $C_1$ = Inside Heat Transfer Coefficient Constant (From Test Results) | .052 | .060 | .071 | .075 | .071 |
| $f_D$ Friction Factor (Darcy) | 0.0474 | 0.0570 | 0.0571 | 0.0624 | 0.0533 |
| $\Delta p_e$/ft = Pressure Drop per Foot | 0.255 | 0.189 | 0.190 | 0.187 | 0.160 |
| $St_e/St_s$ = Stanton Number Ratio (enhanced/Smooth) | 1.93 | 2.01 | 2.37 | 2.52 | 2.38 |
| $\Delta p_e/\Delta p_s$ = Pressure Drop Ratio (Enhanced/Smooth) | 4.55 | 3.38 | 3.39 | 3.34 | 2.85 |
| $\eta = (St_e/St_s)/(\Delta p_e/\Delta p_s)$ = Efficiency index | 0.42 | 0.59 | 0.70 | 0.75 | 0.84 |

TABLE 4

OUTSIDE AND OVERALL PERFORMANCE CHARACTERISTICS OF EXPERIMENTAL COPPER TUBES HAVING MULTIPLE-STRAT INTERNAL RIDGING

| | $h_o$ = Average Boiling Coefficient based on Nominal Outside Area in HCFC-123 Refrigerant (But/hr ft$^2$ F) | $h_o$ = Average Boiling Coefficient based on Nominal Outside Area in HFC-134a Refrigerant (Btu/hr ft F) | $U_o$ = Overall Heat Transfer Coefficient, Based on Nominal Outside Area in HCFC-123 Refrigerant (Btu/hr ft$^2$ F) | $U_o$ = Overall Heat Transfer Coefficient, Based on Nominal Outside Area in HFC-134a Refrigerant (Btu/hr ft) |
|---|---|---|---|---|
| Tube I | 655 | 2,000 | 466 | 944 |
| Tube II | 2,917 | 5,100 | 1200 | 1,490 |
| Tube $III_L$ | 3,889 | N/A | 1,520 | N/A |
| Tube $III_H$ | N/A | 6,600 | N/A | 1,720 |
| Tube $IV_L$ | 6,194 | N/A | 1,760 | N/A |
| Tube $IV_H$ | N/A | 10,000 | N/A | 1,960 |
| Tube $V_L$ | 6,194 | N/A | 1,700 | N/A |
| Tube $V_H$ | N/A | 10,000 | N/A | 1,890 |

FIGS. 6–8 are graphs showing the comparative advantages of tubes IV and V of the present invention relative to prior art tubes. FIG. 6 is a graph comparing heat transfer versus pressure drop characteristics for the heat transfer tubes I–V, which tubes are understood with reference to TABLE 1 and TABLE 2.

A major advantage of tubes IV and V over former art tubes is the increased heat transfer and decreased pressure drop for a constant GPM water flow rate. As can be seen in Table 3, the pressure drop ratio relative to a smooth bore tube, at 5 GPM constant flow rate, for Tube V is almost 60 percent less than for Tube I (40 FPI TURBO-CHIL®). Also from Table 3 one can see that the Stanton Number ratio ($St_e/St_s$) of tube IV is 30% higher than for tube I. Both the above ratios can be combined into a total ratio of heat transfer to pressure drop and is defined as the "efficiency index" as explained in a publication by D. L. Gee and R. L. Webb "Forced Convection Heat Transfer In Helically Rib-Roughened Tubes" published in the International Journal of Heat Mass Transfer, Vol 23, pp 1,127–1,136 (1980). This efficiency index is a total measure of heat transfer to pressure drop compared to a smooth bore tube. The efficiency index for Turbo-BIII (Table 3) is 0.84 vs 0.42 for TURBO-CHIL®, resulting in a 100% improvement.

FIG. 7 is a graph comparing the inside heat transfer performance to a smooth tube for the same five different internally ridged tubes (tubes I–V) at varying water flow rates. Accordingly, FIG. 7 explains the numerator of the efficiency index of FIG. 6.

FIG. 8 is a graph comparing the pressure drop of tubes I–V to that of a smooth tube for different water flow rates. Accordingly, FIG. 8 explains the denominator of the efficiency index of FIG. 6.

FIG. 9 is a graph comparing the overall heat transfer coefficient Uo in HCFC-123 refrigerant at varying heat fluxes, Q/Ao, for tubes I–$IV_L$.

FIG. 10 is a graph of heat flux vs. boiling temperature difference (e.g, $T_{wall}$–$T_{sat}$) for tubes I–$IV_L$ in refrigerant HCFC-123.

FIG. 11 is a graph comparing the overall heat transfer coefficient Uo in HFC-134a refrigerant at varying heat fluxes, Q/Ao for tubes I–$V_H$.

FIG. 12 is a graph of heat flux vs. boiling temperature difference (e.g, $T_{wall}$–$T_{sat}$) for tubes I–$IV_H$ in refrigerant HFC-134a.

FIG. 13 is a graph comparing the overall heat transfer coefficient Uo at varying heat fluxes, Q/Ao and specifically showing the relationship between tube VI and tubes I through $IV_L$.

Figure 14A:
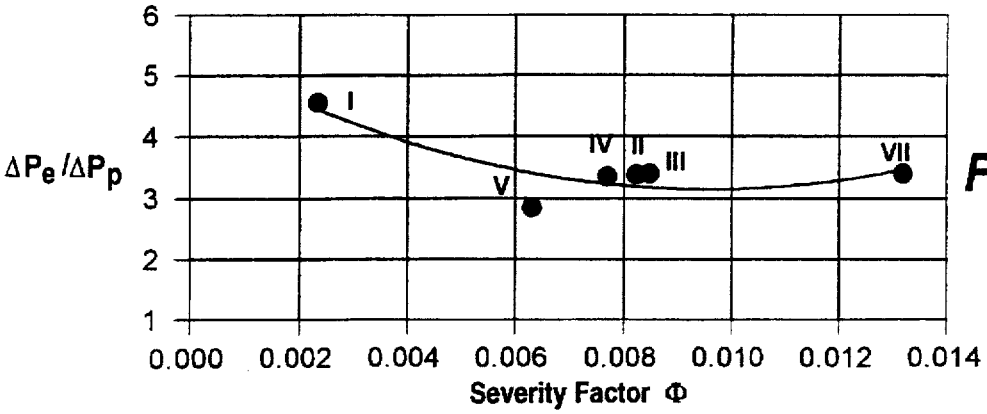
FIG. 14A is a graph showing the relationship between pressure drop and severity factor for tubes I through V and VII.
Figure 14B:
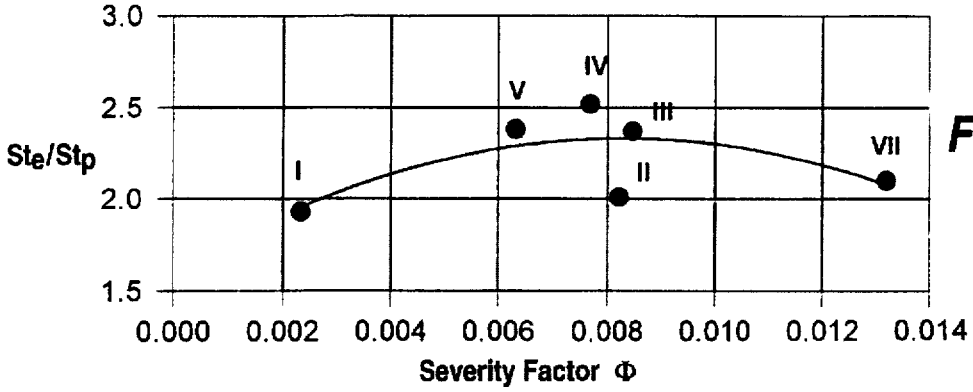
FIG. 14B is a graph showing the relationship between heat transfer and severity factor for tubes I through V and VII.
Figure 14C:
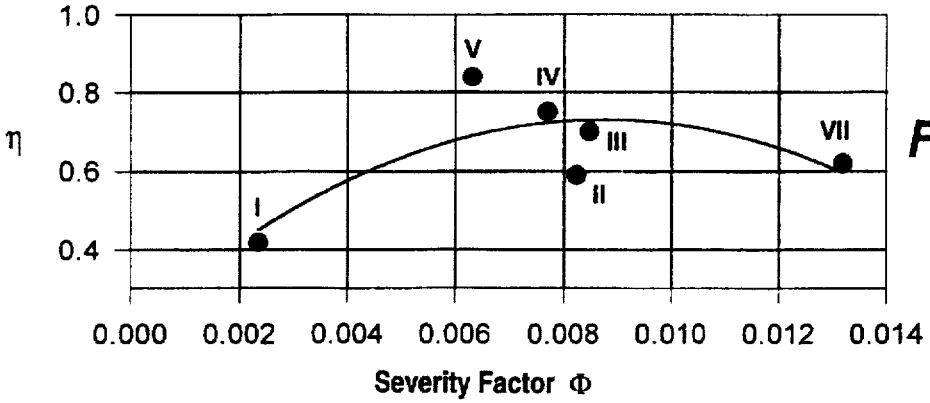
FIG. 14C is a graph showing the relationship between efficiency index and severity factor for tubes I through V and VII.

FIGS. 14A–14C are graphs comparing pressure drop ratio, heat transfer ratio, and efficiency index, respectively, to severity factor for tubes I–V and VII. As seen from these graphs, Tubes IV and V of the present invention have the highest efficiency index $\eta$ (see FIG. 14C); the lowest pressure drop ratio $\Delta P_e/\Delta p_p$ (see FIG. 14A); and the highest heat transfer ratio $St_e/St_p$ (see FIG. 14B), compared to a smooth tube.

In order to achieve improved boiling performance of the outside tube surface 12 in a bundle configuration, for some embodiments it may be desirable to make the surface somewhat non-uniform so that a range of pore sizes are provided in the tube surface. The range should include openings which are both larger and smaller than the pore size which would best support nucleate boiling of a particular refrigerant at a particular set of operating conditions. For example, the notching of the plurality of second notches $N_2$ in the second direction occurs at a pitch to vary the average pore size.

The invention thus provides a nucleate boiling tube for submerged chiller refrigerating applications wherein the tube surface contains cavities which are in a distribution range centered on an optimum size for nucleate boiling of a particular fluid under a particular set of operating conditions.

Advantageously, the present invention provides a heat transfer tube which includes surface enhancements of both its inner and outer tube surfaces, and which can be produced in a single pass in a conventional finning machine.

Moreover, flow of liquid inside the tube is such as to minimize film resistance at a given pressure drop while also increasing the internal surface area so as to further increase heat transfer efficiency. A more efficient tube surface is provided, thereby affording designers of large chillers with improved energy efficiencies.

While the invention has been particularly shown and described with reference to the preferred embodiments thereof, it will be understood by those skilled in the art that various alterations in form and detail may be made therein without departing from the spirit and scope of the invention.

The embodiments of the invention in which an exclusive property or privilege is claimed are defined as follows:

1. In a metallic tube for boiling having an outer surface for submersion in a refrigerant and an inner surface for contacting a liquid heat transfer medium to be chilled, the other surface comprising a plurality of radially outwardly extending helical fins with channels extending between adjacent fins and the inner surface comprising a plurality of helical ridges, the fins of the outer surface being grooved to provide notches, a nucleate boiling pore being formed at a bottom of a notch at each intersection of a notch and a channel, the fins being flattened with flattened adjacent fins forming an enclosed channel segment extending between neighboring pores whereby vaporized refrigerant leaves the channel only by the pores, adjacent notches being non-contiguously spaced apart whereby a flattened fin is intermediate neighboring pores, the pores having an average area of less than 0.00009 square inches.

2. The tube of claim 1, wherein the pores have a density of at least 2000 per square inch of outer surface of the tube.

3. The tube of claim 2, wherein the pores have a density of at least 3000 per square inch of outer surface of the tube.

4. The tube of claim 1, wherein the helical ridges on the inner surface have a predetermined ridge height and pitch and are positioned at a predetermined helix angle, the inner surface having a severity factor $\Phi$ in the range of 0.006 to 0.008, where $\Phi=e^2/p_i d_i$, wherein:

e is the ridge height in inches;

$p_i$ is the axial pitch of the helical ridges in inches; and $d_i$ is the maximum inner diameter of the tube in inches.

5. The tube of claim 1, wherein the plurality of helical fins are axially spaced at a pitch less than 0.01754 inch.

6. The tube of claim 1, wherein the plurality of helical fins are axially spaced at a pitch less than 0.01667 inch.

7. The tube of claim 1, wherein the plurality of fins are circumferentially notched so as to define at least a first set of notches arranged at angles which are in the range of 30° to 45° relative to a plane of each fin.

8. The tube of claim 7, wherein the said at least first set of notches has its notches spaced around a circumference of each fin at a distance no greater than 0.03 inch from each other as measured along the circumference of the fin at a base of the notches.

9. The tube of claim 1, wherein said plurality of fins are circumferentially notched so as to include a first set of notches and a second set of notches, the second set of notches overlying portions of the first set of notches, said second set of notches being positioned at an angle in the range of 0°–90° relative to the plane of the fins.

10. The tube of claim 9, wherein said plurality of fins are circumferentially notched so as to have at least one of the first set and second set of notches arranged at angles which are in the range of 30° to 40° relative to the plane of each fin.

11. The tube of claim 1, wherein the pores preferably have an average area in a range from 0.00005 square inches to 0.000075 square inches.

12. The tube of claim 1, wherein the pores preferably have an average area in a range from 0.00002 square inches to 0.000065 square inches.

13. A method of fabricating a metallic tube for boiling, the metallic tube being of a type having an outer surface for submersion in a refrigerant and an inner surface for contacting a liquid heat transfer medium to be chilled, the method comprising:

(1) forming a plurality of helical ridges on the inner surface of the tube;

(2) providing a plurality of radially outwardly extending helical fins on the outer surface of the tube with channels extending between adjacent fins;

(3) grooving the fins to provide notches and a nucleate boiling pore at a bottom of each intersection of a notch and a channel;

(4) flattening the fins whereby flattened adjacent fins form an enclosed channel segment extending between neighboring pores so that vaporized refrigerant in the enclosed channel leaves the channel only by the pores, adjacent notches being non-contiguously spaced apart whereby a flattened fin is intermediate neighboring pores:

the fins and notches being spaced whereby the pores have an average area less than 0.00009 square inches.

14. The method of claim 13, wherein the notching of step (3) comprises forming a plurality of first notches in a first direction; and wherein the method further comprises forming a plurality of second notches in a second direction.

15. The method of claim 14, wherein the notching of the plurality of second notches in the second direction occurs at a pitch to vary the average pore size.

16. A method of fabricating a metallic tube for boiling, the metallic tube being of a type having an outer surface for contacting a refrigerant and an inner surface for contacting a liquid heat transfer medium to be chilled, the method comprising:

(1) forming a plurality of helical ridges on the inner surface of the tube:

(2) providing a plurality of radially outwardly extending helical fins on the outer surface of the tube;

(3) notching the fins to provide nucleate boiling pores by forming a plurality of first notches in a first direction and forming a plurality of second notches in a second direction;

the fins and notches being spaced whereby the pores have an average area of less than 0.00009 square inches: and wherein the notching of the plurality of second notches in the second direction occurs at a cross notch pitch which differs from a pitch of the first set of notches.

17. The method of claim 13, wherein the pores preferably have an average area in a range from 0.00005 square inches to 0.000075 square inches.

18. The method of claim 13, wherein the pores preferably have an average area in a range from 0.00002 square inches to 0.000065 square inches.

19. A method of fabricating a metallic tube for boiling, the metallic tube being of a type having an outer surface for contacting a refrigerant and an inner surface for contacting a liquid heat transfer medium to be chilled, the method comprising:

(1) forming a plurality of helical ridges on the inner surface of the tube;

(2) providing a plurality of radially outwardly extending helical fins on the outer surface of the tube;

(3) notching the fins forming a plurality of first notches in a first direction;

(4) notching the fins forming a plurality of second notches in a second direction;

wherein the notching of the plurality of second notches in the second direction occurs at a pitch to vary the average pore size.

20. The method of claim 19, wherein the fins and notches being spaced whereby the pores have an average area less than 0.00009 square inches.

21. The method of claim 19, wherein the pores preferably have an average area in a range from 0.00005 square inches to 0.000075 square inches.

22. The method of claim 19, wherein the pores preferably have an average area in a range from 0.00002 square inches to 0.000065 square inches.

23. The tube of claim 1, wherein adjacent notches are non-contiguously spaced apart by a notch pitch in a range of 0.020 to 0.025 inches.

* * * * *